US006550298B1

(12) United States Patent
Su

(10) Patent No.: US 6,550,298 B1
(45) Date of Patent: Apr. 22, 2003

(54) LOCKSET KEYWAY COVER-UP MECHANISM

(76) Inventor: Liang-Chin Su, No. 19, Pao-Sheng Rd., Kung-Kuan Tsun, Hu Nei Shiang, Kaohsiung Hsien (TW)

( * ) Notice: Subject to any disclaimer, the term of this patent is extended or adjusted under 35 U.S.C. 154(b) by 0 days.

(21) Appl. No.: 09/971,724

(22) Filed: Oct. 9, 2001

(51) Int. Cl.[7] ..... E05B 47/00

(52) U.S. Cl. ..... 70/276; 70/413; 70/455; 70/427

(58) Field of Search ..... 70/276, 413, 455, 70/454, 423, 427

(56) References Cited

U.S. PATENT DOCUMENTS

| | | | | | |
|---|---|---|---|---|---|
| 1,789,756 | A | * | 1/1931 | Jacobi | 70/455 |
| 3,434,318 | A | * | 3/1969 | Thiry | 70/455 |
| 3,602,020 | A | * | 8/1971 | Kajita | 70/276 |
| 3,782,147 | A | * | 1/1974 | Hallmann | 70/276 |
| 3,837,195 | A | * | 9/1974 | Pelto | 70/276 |
| 3,837,525 | A | * | 9/1974 | Kobayashi | 70/276 X |
| 3,861,182 | A | * | 1/1975 | Skinner | 70/455 |
| 4,022,038 | A | * | 5/1977 | Miller | 70/276 |
| 4,226,104 | A | * | 10/1980 | Oliver | 70/455 |
| 4,312,198 | A | * | 1/1982 | Sedley | 70/276 |
| 4,603,563 | A | * | 8/1986 | Mochida et al. | 70/276 |
| 4,716,922 | A | * | 1/1988 | Camp | 70/276 X |
| 4,815,304 | A | * | 3/1989 | Kesselman | 70/276 X |
| 5,109,686 | A | * | 5/1992 | Toussant | 70/454 |
| 5,193,371 | A | * | 3/1993 | Yamane | 70/276 |
| 5,299,436 | A | * | 4/1994 | Spitzer | 70/276 X |
| 5,394,716 | A | * | 3/1995 | Dreyer | 70/276 |
| 5,605,065 | A | * | 2/1997 | Lopez-Casals et al. | 70/276 |
| 5,664,449 | A | * | 9/1997 | Sedley | 70/276 |
| 5,758,524 | A | * | 6/1998 | Yu | 70/276 |
| 5,850,752 | A | * | 12/1998 | Lax | 70/276 |

* cited by examiner

*Primary Examiner*—Suzanne Dino Barrett
(74) *Attorney, Agent, or Firm*—Rosenberg, Klein & Lee

(57) ABSTRACT

A lockset keyway cover-up mechanism is composed of a rotor, a retainer, a bushing, magnetic pins and springs adapted with a key, which is provided with an unlocking part containing multiples of magnets, characterized by that the keyway and multiples of pinholes to accommodate the springs and those magnetic pins are directly or with a rotor case cover provided on the front end of the rotor; multiples of insertion holes are provided in recess on the retainer so that the retainer holds against the end of the rotor by means of the bushing and those insertion holes of the retainer are held in position by the insertion of those magnetic pins protruding from the front face of the rotor for the through hole of the retainer to be at a location apart from the keyway, which in turn is covered up.

6 Claims, 13 Drawing Sheets

LOCKSET KEYWAY COVER-UP MECHANISM

BACKGROUND OF THE INVENTION (a) Field of the Invention

The present invention is related to a lockset assembly having a keyway cover-up mechanism to prevent entry of dust or other foreign matter into the keyway, and more particularly, to one having magnetic pins and a retainer either integrally formed with or separately mounted to the front face of a rotor defining the keyway. The retainer is rotatable relative to the rotor and may be locked in position to effectively cover the keyway, and may be unlocked by employing the magnetic force between opposing magnetic components.

(b) Description of the Prior Art

The prior art as taught in Japanese Patent No. JP11044132 essentially has provided therein multiple irregular holes on a front face of a rotor to accommodate corresponding magnetic pins mounted together with a cover plate, retainer and bonnet on the front end of the rotor. A circumferential portion of the retainer is provided with retaining walls and pushed by spring to constantly maintain upward elasticity. Through holes and perforations are provided on the bonnet, and multiple magnetic pieces are provided at the head of the key. The through holes are covered as the keyway remains covered due to the retainer being restricted by the pins being prevented from moving upward. The perforations on the bonnet are also closed by the cover plate. Upon unlocking, the magnetic pieces from the key are pressed against the cover plate inside the perforations, and the pins are rejected by the magnetic pieces having repulsive magnetic poles. The pins retreat from the retaining walls to allow the retainer's movement upward by elastic force of the spring to expose the keyway.

The prior art operates essentially by retreating the retainer by taking advantage of the rejection force existing between the magnetic pieces on the key and pins extending from the front of the rotor to release the retainer for longitudinal displacement to permit access to the keyway. Though serving its purpose to cover the keyway, the structure of the prior art requires more members and higher manufacturing precision, since the retainer relies entirely upon the spring to slide to a fixed point before the keyway is fully exposed. As a result, the assembly of the prior art is very complex, yielding increased production costs. It is also vulnerable to failure during use. Furthermore, the retainer consumes much space, as it is partially exposed when released and must be pressed by the user to again cover the keyway. The exposed retainer, in addition, threatens to cut the user.

SUMMARY OF THE INVENTION

The primary purpose of the present invention is to provide a lockset assembly having a cover-up mechanism for a keyway of a lockset that is safer and more compact in structure with minimal tendency to fail. The subject lockset assembly comprises a rotor, a retainer, a bushing, magnetic pins and spring, and a key containing a magnetic part for actuation. A rotor case cover is provided on a front end of the rotor with a keyway and multiple pin holes formed to accommodate springs and magnetic pins. The retainer has a through hole corresponding to the keyway and multiple insertion holes to receive pins protruding from the front face of the rotor, such that the retainer is held in position. A bushing captures the retainer against the end of the rotor.

Once the unlocking part of the key engages the retainer, the magnetic pins retreat due to repulsive magnetic force, permitting the retainer to rotate relative to the rotor so that the through hole may be moved either in or out of alignment with the keyway.

Another purpose of the present invention is to provide a lockset assembly having a cover-up mechanism for a keyway that gives agile operation of a key applicable to various structures of the lockset. In one embodiment of the lockset assembly comprising a rotor, a retainer, a bushing, magnetic pins and springs, and a key containing an unlocking part, an independent case cover is provided on the front end of the rotor, and multiple tabs extend backward from a circumferential portion of the bushing to engage a front end of the rotor case cover and thereby capture the retainer. The bushing and the rotor case cover are thus both fixedly attached to the front end of the rotor.

Yet another purpose of the present invention is to provide a lockset assembly having a cover-up mechanism for a keyway wherein a slot is formed in one embodiment on the front face of an unlocking part of the key which engages the retainer. A mating block for the slot is formed on the outer side of the retainer offset from the through hole so that the mating block's coupling with the slot provides sufficient engagement to achieve easy operation of the mechanism.

DETAILED DESCRIPTION OF THE PREFERRED EMBODIMENTS

Figure 1:
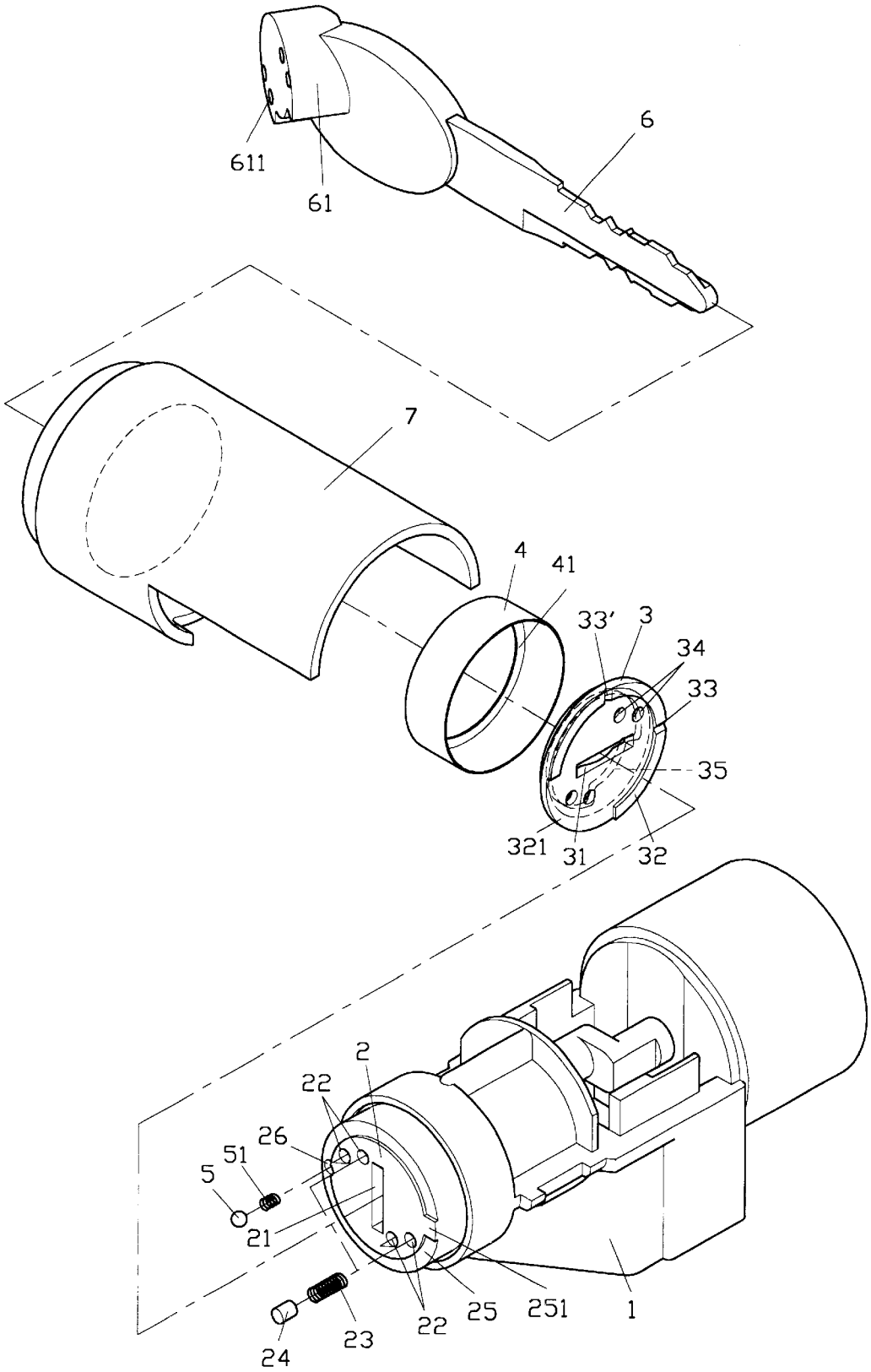
FIG. 1 is a schematic view showing a structure of a first preferred embodiment of the present invention.
Figure 2:
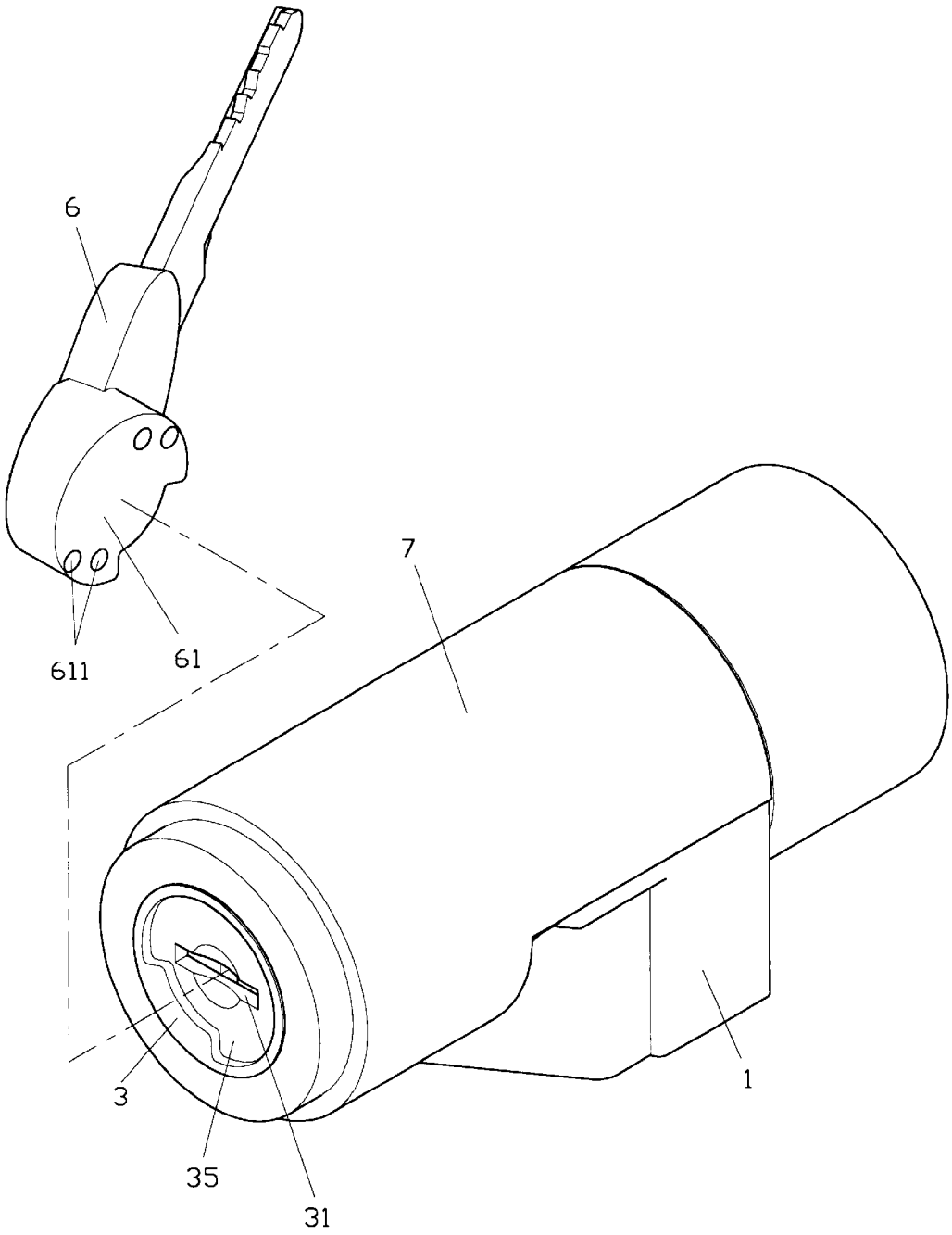
FIG. 2 is a view showing an assembly of the first preferred embodiment of the present invention.

Referring to FIGS. 1 and 2, a first preferred embodiment of the present invention comprises a rotor (1), a rotor case cover (2), a retainer (3), a bushing (4), springs (23) and magnetic pins (24), and a key (6). The rotor (1) is axially provided with the rotor case cover (2). The rotor case cover (2) is formed with a keyway opening (21) at the center of its front face, and with multiple pin holes (22) to receive the springs (23) and magnetic pins (24). A recessed guiding channel (25) is provided on a circumferential portion of the rotor case cover (2). A stopper (251) is formed as shown, as is a positioning hole (26) for receiving therein a positioning bead (5) and its spring (51).

The retainer (3) forms an independent plate corresponding in shape to the rotor case cover (2). It is provided at a center of its front face with a through hole (31) that preferably correlates in shape to the keyway (21). The retainer (3) is formed with a retaining wall (32) disposed about a gap (321). The retaining wall (32) protrudes from the circumferential portion of its front facing the rotor case cover (2). Two slots (33) and (33') are provided apart from each other at suitable angles on the retaining wall (32), and multiple insertion holes (34) are provided in an inner side of the retainer (3). An irregular-shaped concave portion (35) is provided on the other side of the retainer (3).

The bushing (4) forms a ring corresponding in shape to the rotor case cover (2), and has at a circumferential portion of its front end a retaining ring (41). Multiple locking walls may be provided at the circumferential portion of the other end of the bushing (4) so as to further secure it to the rotor case cover (2). (However, in this preferred embodiment, the bushing forms a flush ring).

The key (6) is provided with a built-in unlocking part (61) containing multiple magnets (611) at its stalk. The unlocking part (61) is formed to correspond in shape to the shaped concave portion (35) of the retainer (3), and the magnetism of the magnets (611) is the same as that of the pins (24) of the rotor case cover (2).

The casing (7) is provided to cover the rotor (1) and those members contained by the rotor (1).

Figure 3:
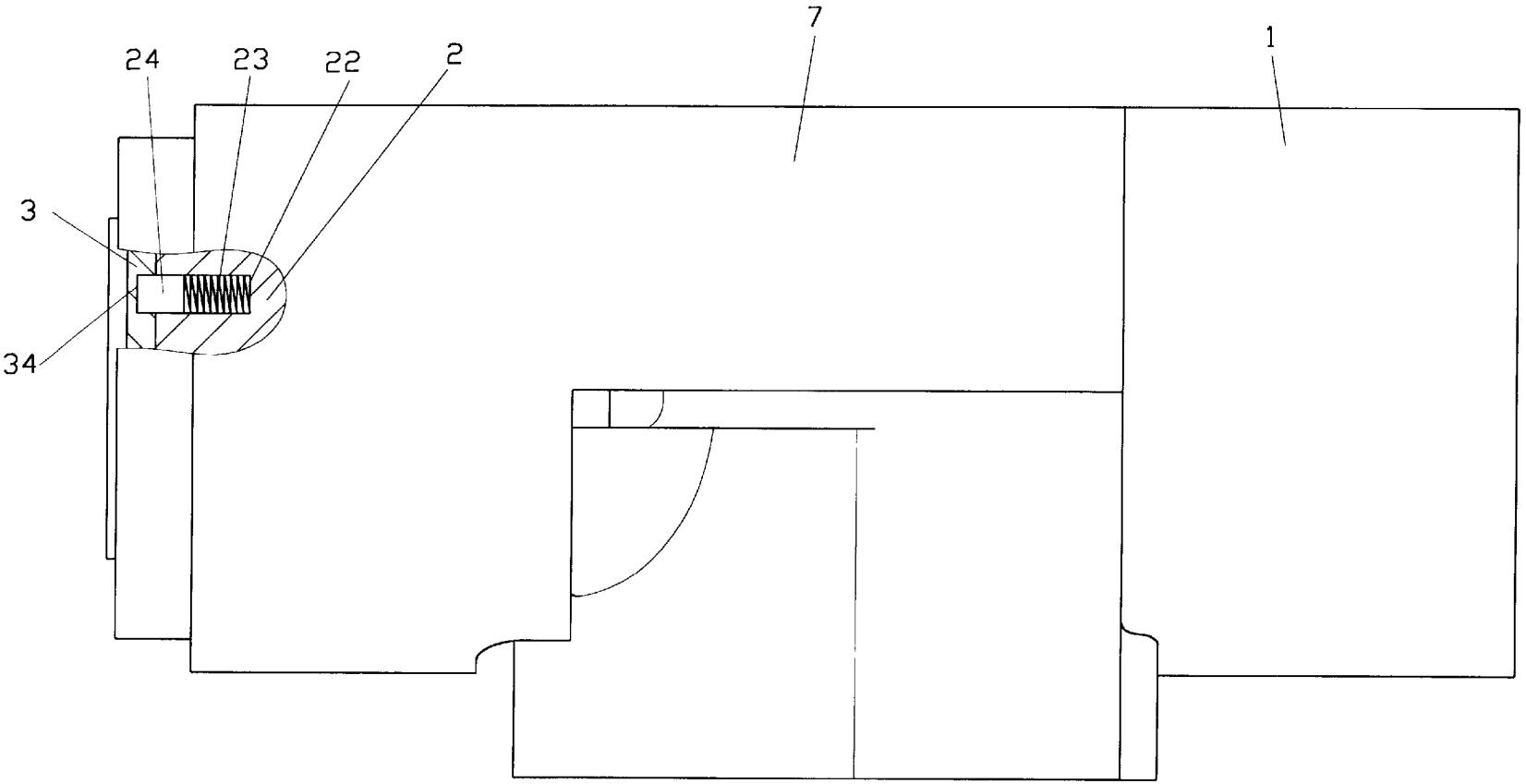
FIG. 3 is a schematic view showing the side view of a locking operation by the first preferred embodiment of the present invention.
Figure 4:
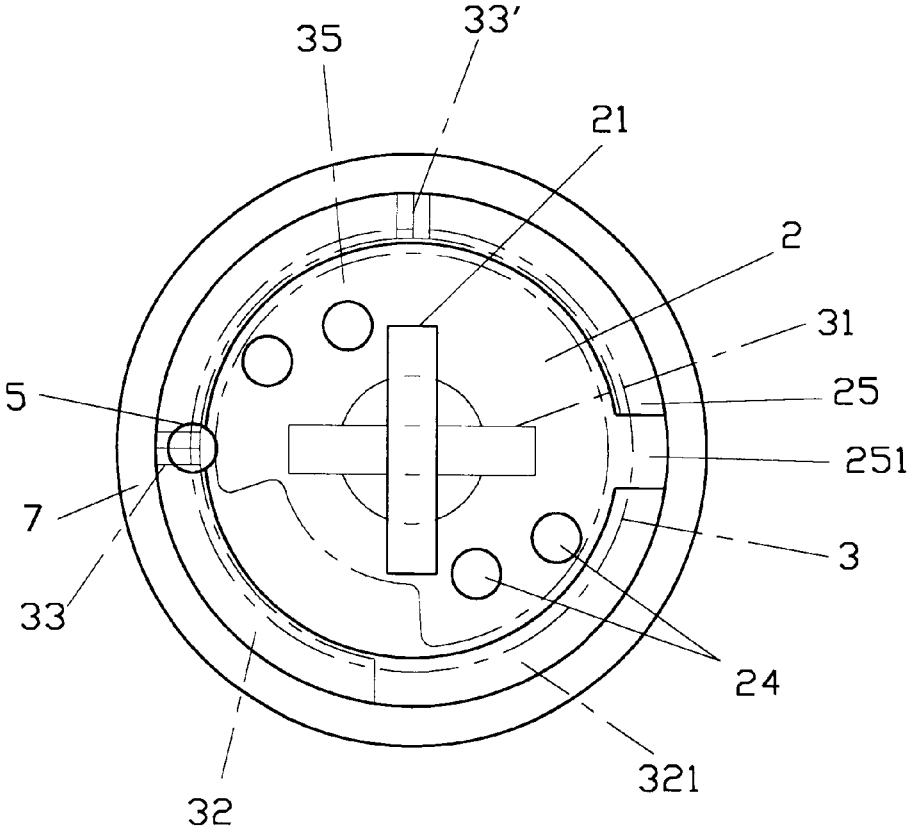
FIG. 4 is another schematic view showing the front view of a locking operation by the first preferred embodiment of the present invention.

Upon assembling as illustrated in FIGS. 3 and 4, the retainer (3) is held flush against the front end of the rotor case cover (2), with the stopper (251) of the guiding channel (25) being received in the gap (321) of the retainer (3). And the positioning bead (5) is held in position against the slot (33) on the retainer (3). The bushing (4) is inserted such that the retainer (3) and the magnetic pins (24) are held in position at the front end of the rotor case cover (2), encompassed by the retaining ring (41) of the bushing (4). (However, even with the absence of the bushing (4), the casing (7) may be used to hold the retainer (3) against the front end of the rotor case cover (2)). The casing (7) engages the rotor (1) to cover its members and thereby form an integral lockset assembly structure. Since the magnetic pins (24) protruding from the front face of the rotor case cover (2) are biased by the springs (23), the retainer (3) is held in position when the insertion holes (34) are engaged by the pins (24). Meanwhile, the through hole (31) of the retainer (3) is oriented relative to the keyway (21) to cross and thereby cause substantial covering of the keyway (21).

Figure 5:
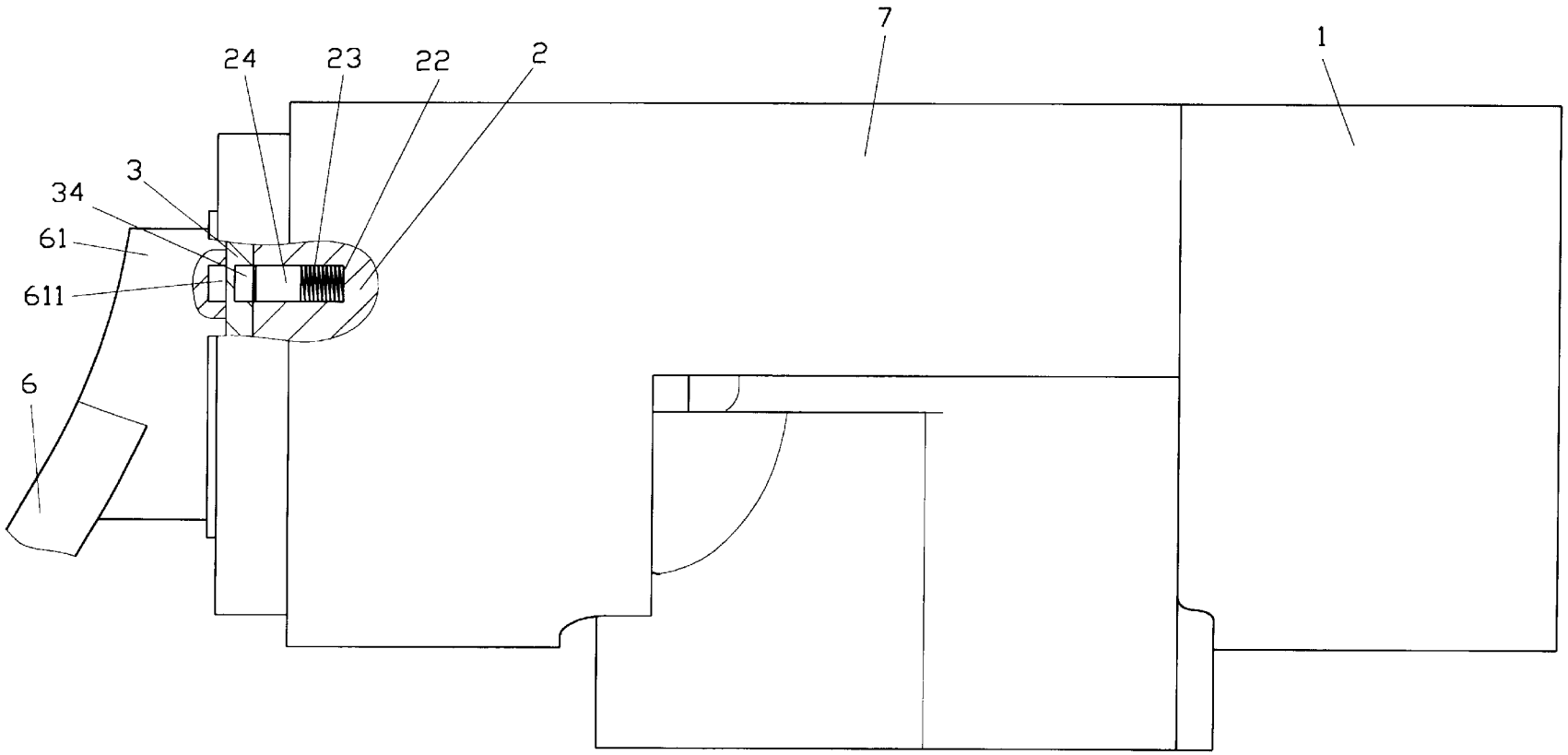
FIG. 5 is a schematic view showing the side view of an unlocking operation by the first preferred embodiment of the present invention.
Figure 6:
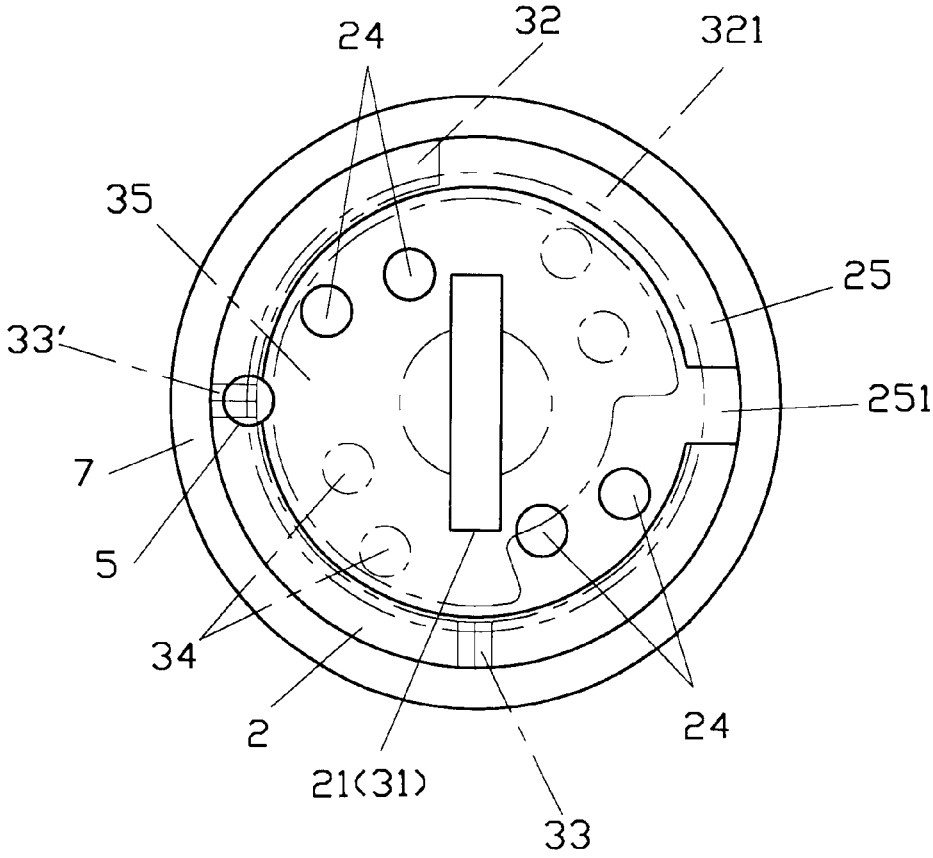
FIG. 6 is another schematic view showing the front view of an unlocking operation by the first preferred embodiment of the present invention.

To unlock as illustrated in FIGS. 5 and 6, the unlocking part (61) of the key (6) is attached to the concave portion (35) of the retainer (3). Since both the magnets (611) inside the unlocking part (61) and the magnetic pins (24) inside the rotor case cover (2) share the same magnetism, the repulsion between them forces the magnetic pins (24) projecting into the insertion holes (34) of the retainer (3) to retreat into the pinholes (22). As those magnetic pins (24) clear away from the insertion holes (34) of the retainer (3), the retainer (3) is free to rotate as illustrated in FIG. 5. Meanwhile, the unlocking part (61) of the key (6) is completely flush with the concave portion (35) such that the retainer (3) may be turned via the resulting engagement. The gap (321) is moved in relation to the stopper (251) on the circumferential portion of the rotor case cover (2) until the stopper (251) holds against one edge of the retaining wall (32) to block further displacement of the retainer (3). The retainer (3) is thereafter relocated in position as the positioning bead (5) once against projects into the slot (33') of the retainer (3). The through hole (31) on the retainer (3) is then aligned with the keyway (21) such that the key (6) may be inserted into the keyway (21) for unlocking.

Figure 7:
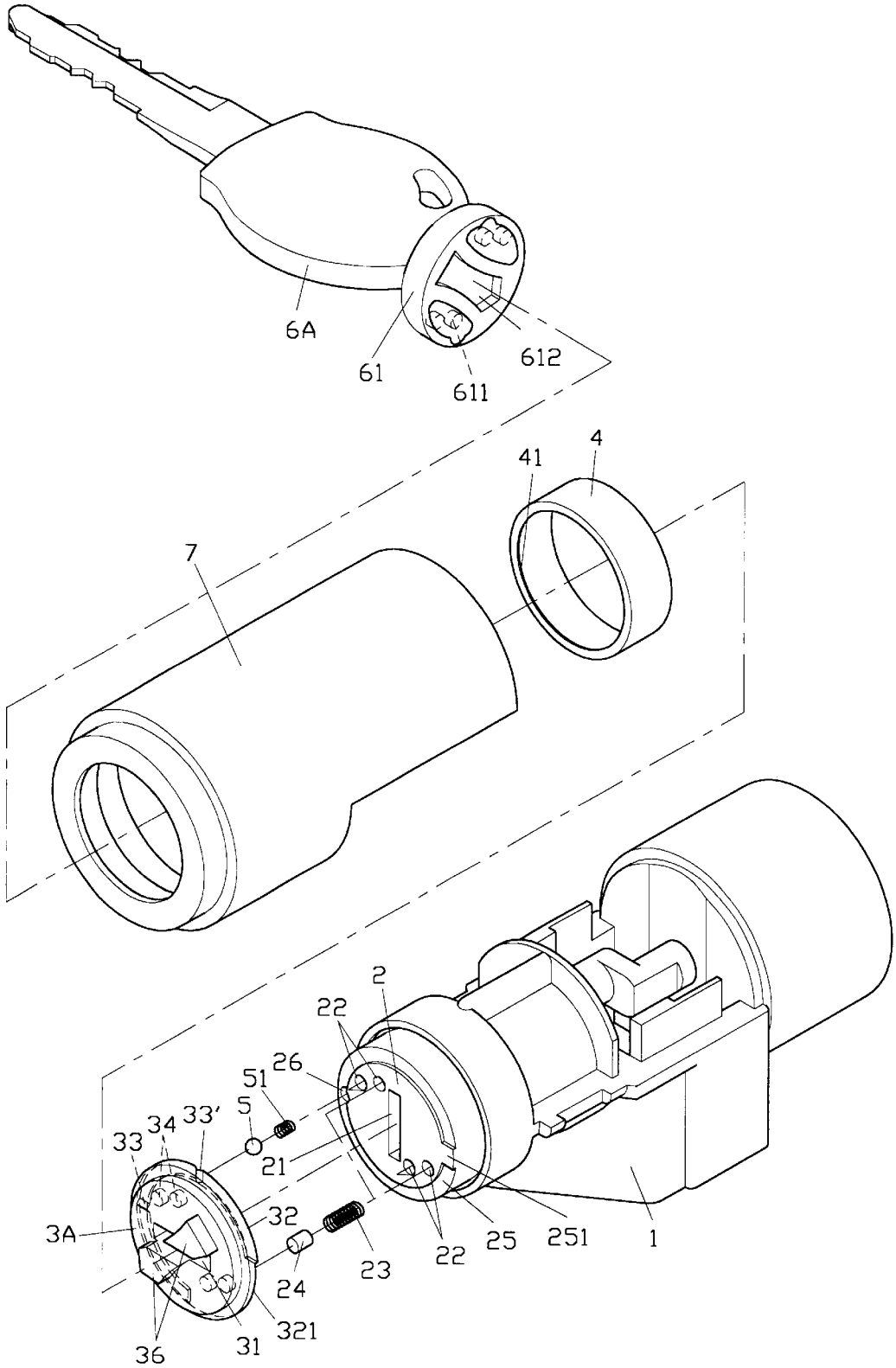
FIG. 7 is a schematic view showing a structure of an assembly of a lockset of a second preferred embodiment of the present invention.

Referring to FIG. 7, a second preferred embodiment of the present invention having the same lockset as that illustrated in the first preferred embodiment, comprises a rotor (1), a rotor case cover (2), a retainer (3A), a bushing (4), Springs (23) and magnetic pins (24), and a key (6A). The rotor case cover (2) is axially provided in the rotor (1), and on the front face of the rotor case cover (2) are formed a keyway (21) and multiple pinholes (22) to accommodate the springs (23) and the magnetic pins (24). A recessed guiding channel (25) is provided on the circumferential portion of the rotor case cover (2). A stopper (251) is formed as shown, as is a positioning hole (26) for receiving a positioning bead (5) and its spring (51).

The retainer (3A) corresponds in shape to the rotor case cover (2) and generally forms a plate having a through hole (31) correlating to the keyway (21) at a center of its front surface. A retaining wall (33) is formed about a gap (321) to protrude from a circumferential portion of the front surface. Two slots (33) and (33') are provided on the retaining wall (32), and multiple insertion holes (34) are provided in an inner side of the retainer (3). The bushing (4) is formed to correspond in shape to the rotor case cover (2), and has at a circumferential portion of its front end a retaining ring (41).

The stalk of the key (6A) has an unlocking part (61) containing multiple magnets (611), and the magnetism of those magnets (611) is the same as that of the magnetic pins (24) of the rotor case cover (2), so as to repel therefrom. The casing (7) is provided to cover the rotor (1) and those members contained by the rotor (1).

Figure 8:
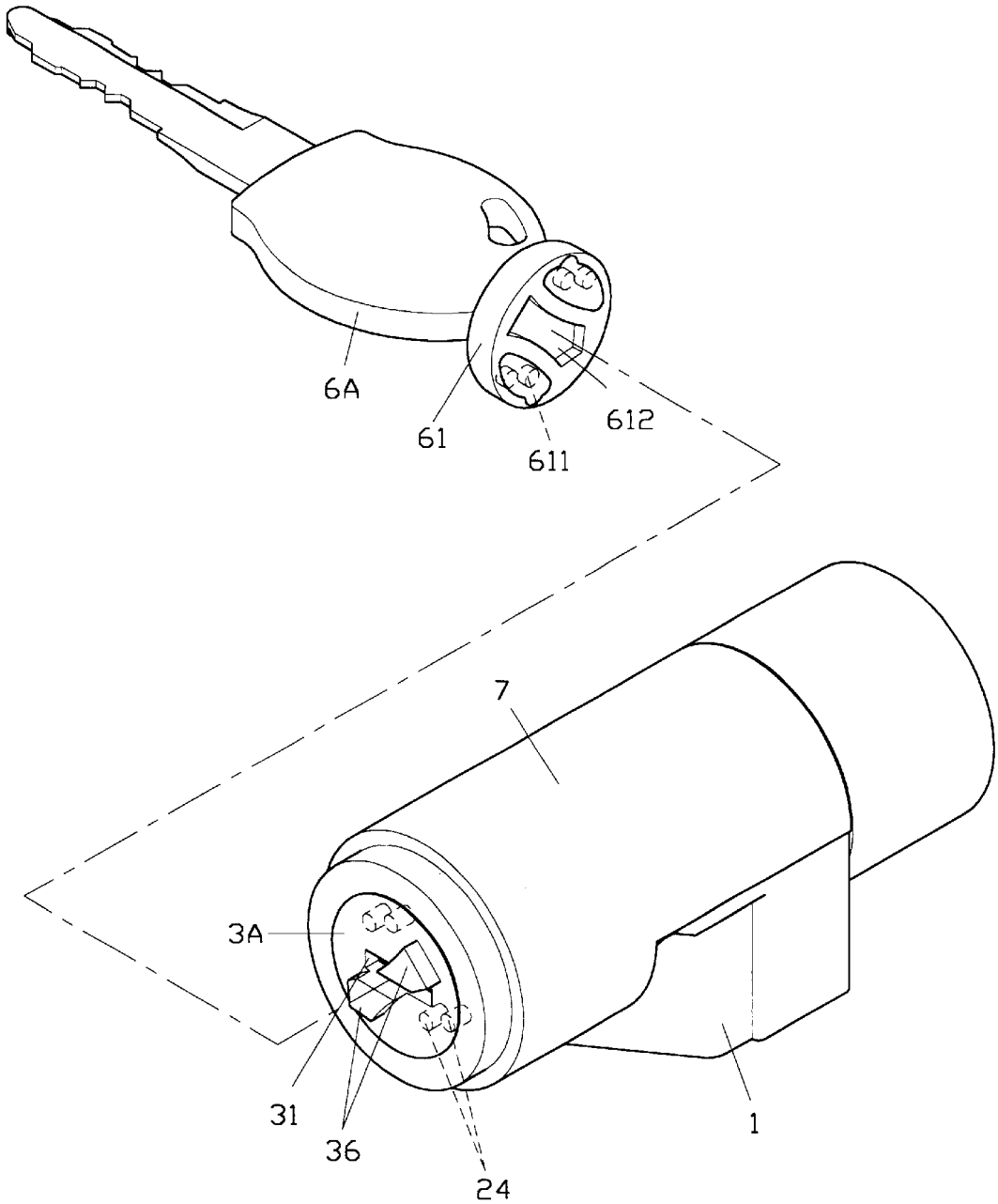
FIG. 8 is a schematic view showing a characteristic structure of the second preferred embodiment of the present invention.

As illustrated in FIG. 8, in the second preferred embodiment, a slot (612) is formed on a front surface of the unlocking part (61) of the key (6A) to mate with the retainer (3). A corresponding bit (36), offset from the through hole (31), is formed on the outer side of the retainer (3A) to be inserted into the slot (612). The insertion of the bit (36) into the slot (612) provides sufficient engagement to turn the retainer (3A) via the key (6A).

Figure 9:
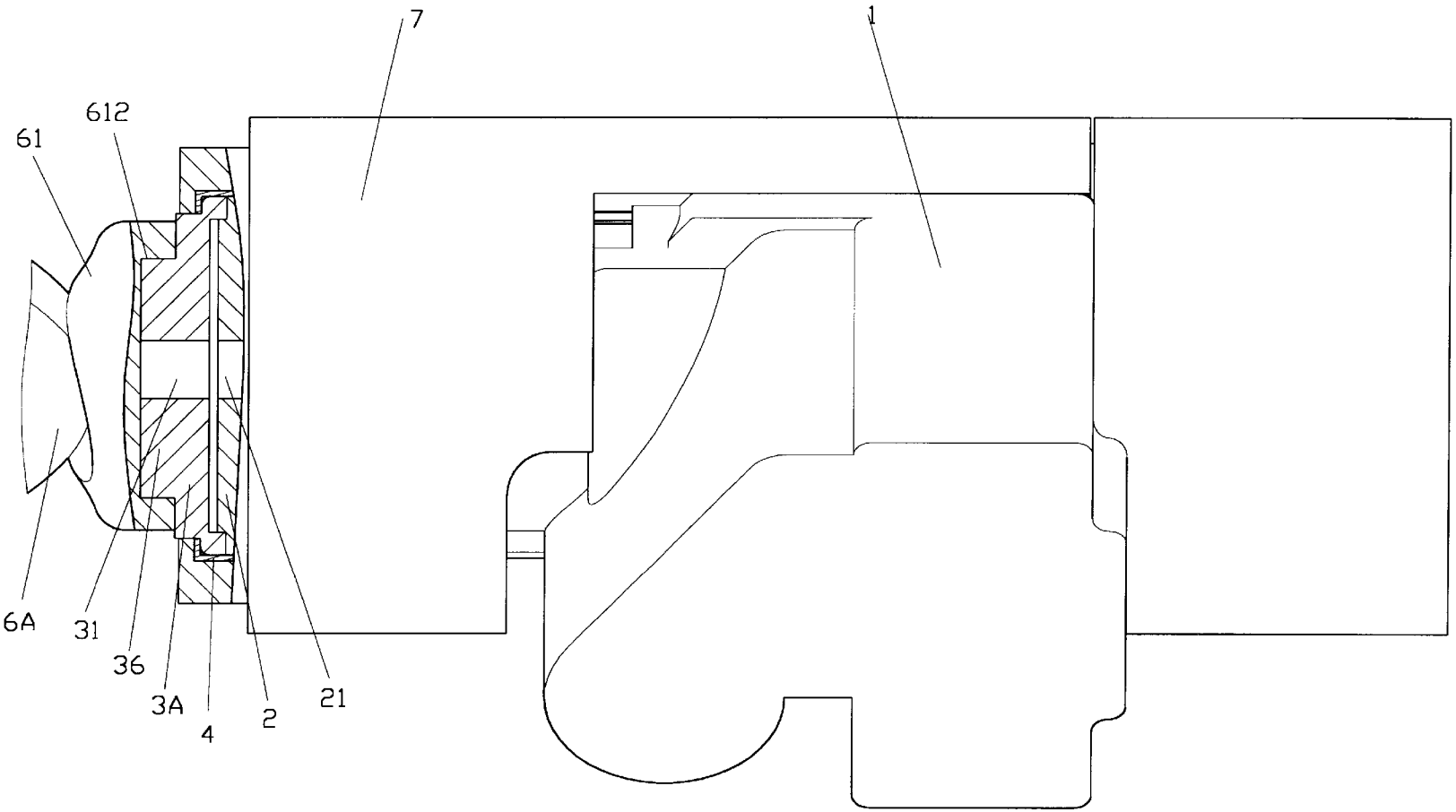
FIG. 9 is a schematic view showing the second preferred embodiment of the present invention in use.
Figure 10:
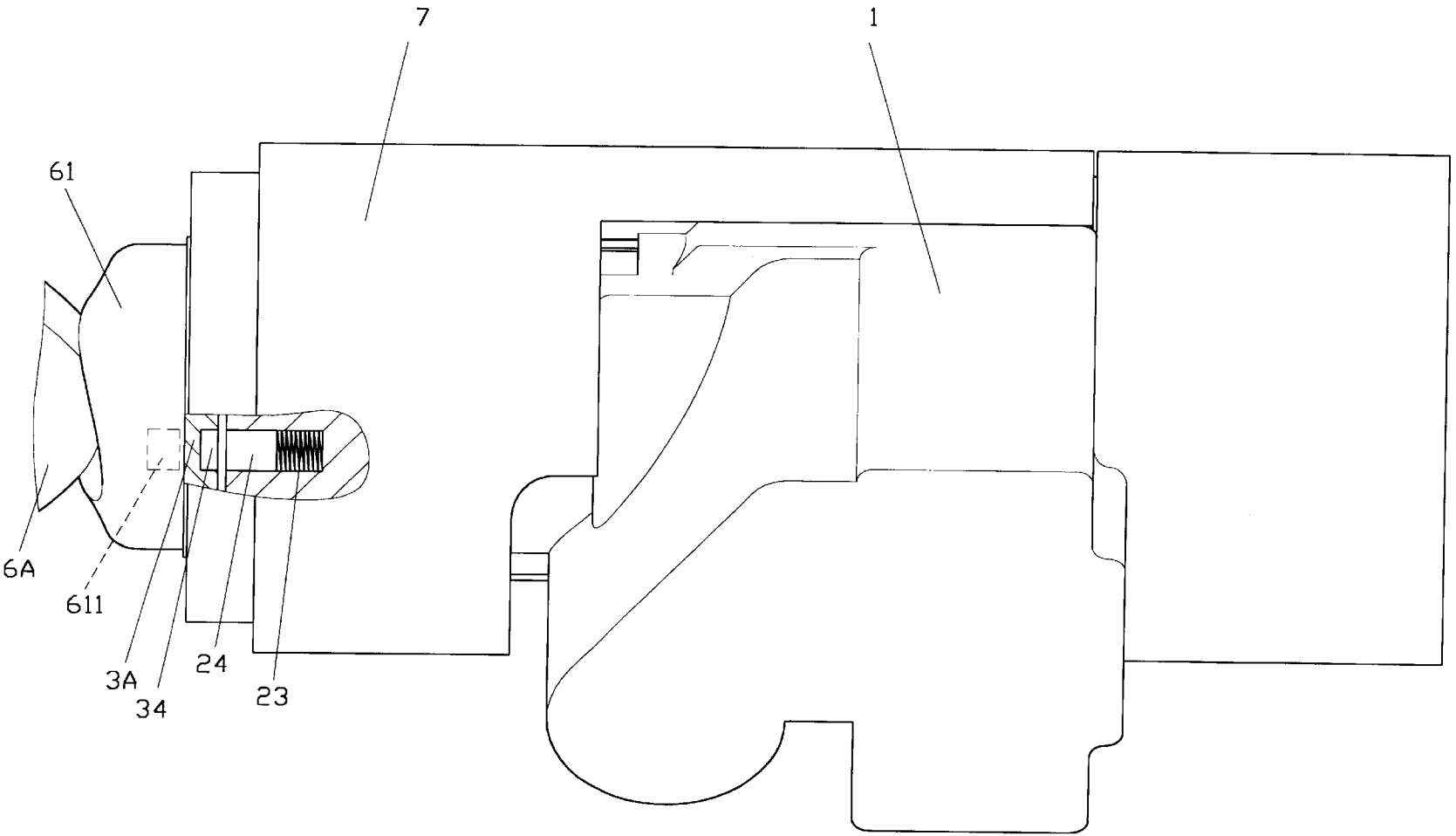
FIG. 10 is another schematic view showing the second preferred embodiment of the present invention in use.

Referring to FIG. 9, the unlocking part (61) of the key (6A) is engaged with the outer side of the retainer (3A) for the slot (612) on the front surface of the unlocking part (61) to receive insertion of the bit (31) on the outer side of the retainer (3A) in a given direction. The magnets (611) inside the unlocking part (61) are so located at positions relative to the magnetic pins (24) (referring to FIG. 10) that they repel the magnetic pins (24). The unlocking part (61) of the key (6A) may then be turned to drive the retainer (3A) to rotate until its through hole (31) aligns with the keyway (21). The key (6A) may thereafter be inserted to unlock the lockset.

In the second preferred embodiment, the retainer engaging portion of the key (6A) is provided on an end face of the unlocking part (61), permitting more options in the contour and design of the appearance of the key (6A). Meanwhile, the bit (36) on the outer side of the retainer (3A) can be made thicker to give better strength for security purposes.

Figure 11:
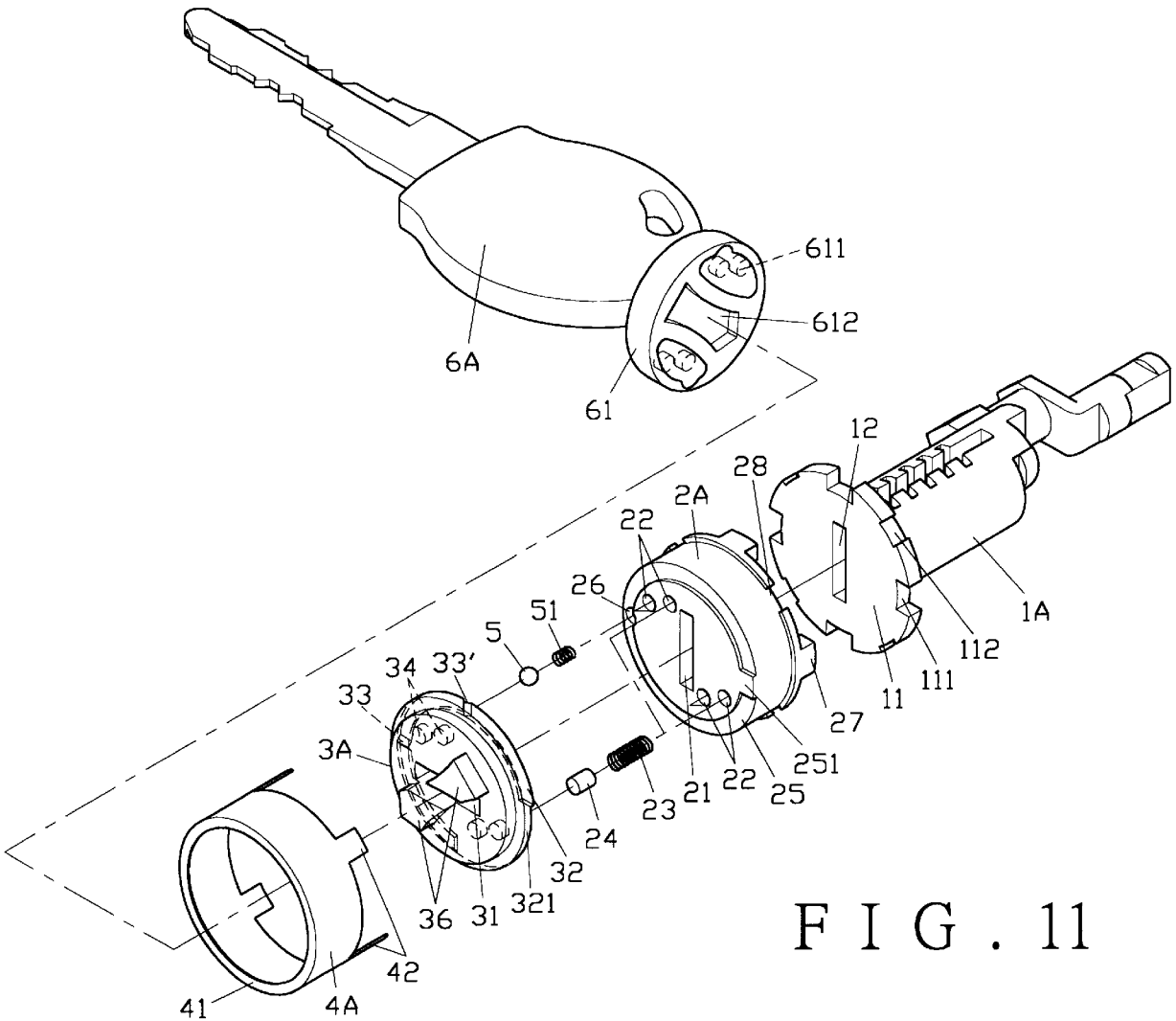
FIG. 11 is an exploded view of a third preferred embodiment of the present invention.

As illustrated in FIG. 11, a third preferred embodiment of the present invention has a structure similar to that of the second preferred embodiment. It comprises a rotor (1A), a rotor case cover (2A), a retainer (3A), a bushing (4A), springs (23), magnetic pins (24), a positioning bead (5) and spring (51), a casing (7), and a key (6A).

The rotor (1A) may be of any suitable configuration formed with a keyway (12) on its front face (11), and two sets of radial edge slots (111) and (112) formed at equal spacing circumferentially about the front face (11). At lest one of any bit (27) projects from the rear end of the rotor case cover (2A) to engage a slot (111). The rotor case cover (2A) is formed with slots (28) disposed in alignment with the slots (112). Multiple tabs (42) protrude backward from a circumferential portion of the rear end of the bushing (4A).

Figure 12:
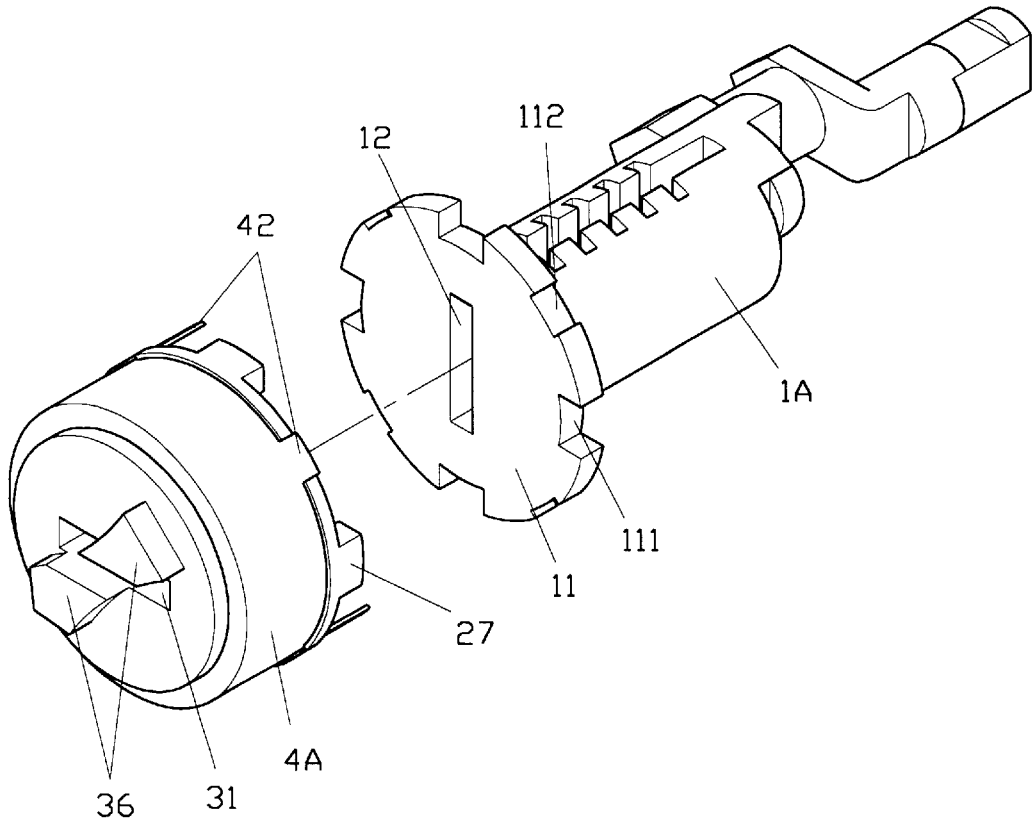
FIG. 12 is a view showing a local combination of the third preferred embodiment of the present invention; and, FIG. 13 is a schematic view showing an assembly of the third preferred embodiment of the present invention.
Figure 13:
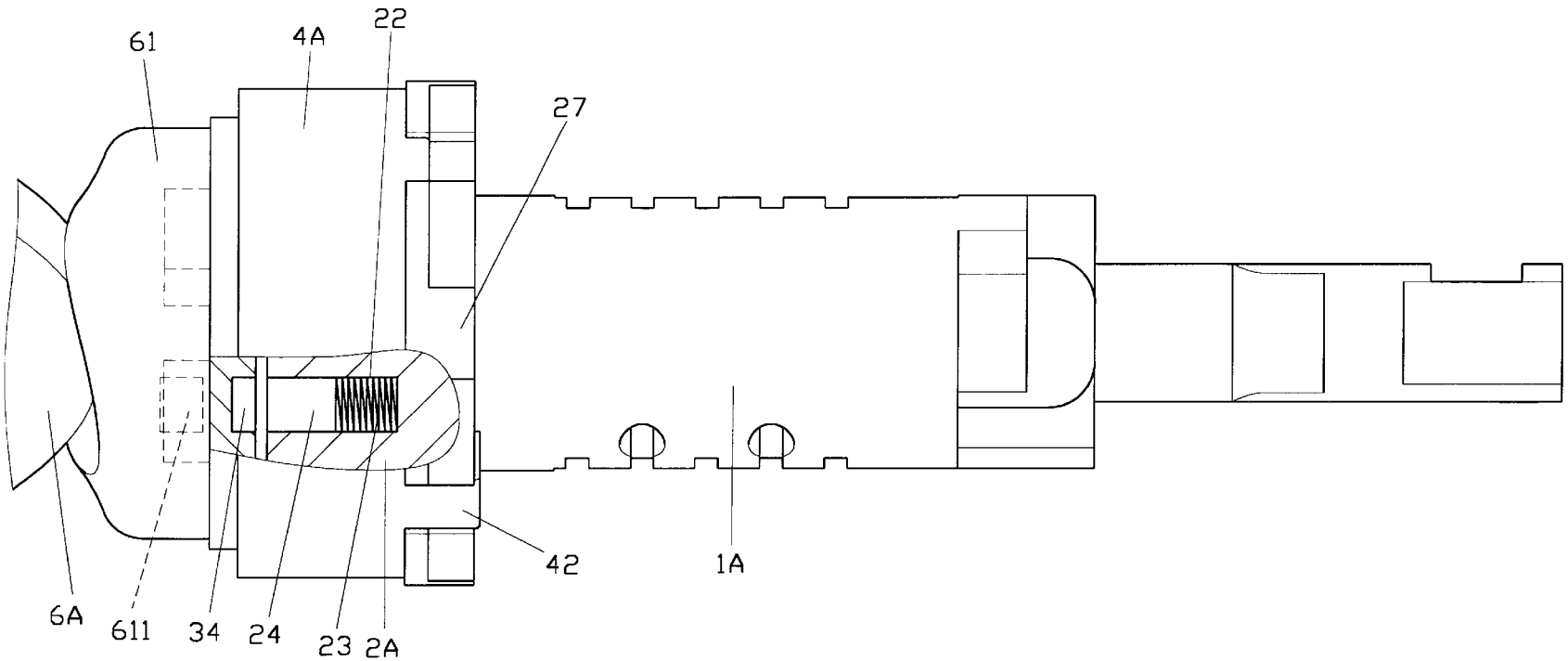

Upon assembling as illustrated in FIGS. 12 and 13 for the third preferred embodiment of the present invention, each bit (27) of the rotor case cover (2A) is inserted into a slot (111) of the rotor (1A), and the extended tabs (42) of the bushing (4A) are inserted into slots (28) and (112). The tabs (42) are then bent and locked to the front face (11) of the rotor (1A). The retainer (3A) is thus incorporated with the rotor case cover (2A) to form a modular unit to be adapted to any type of rotor applied in any type of lockset. In practice, more of the tabs (42) may be provided; and, the rotor case cover (2A), the retainer (3A), the bushing (4A), the springs (23), the magnetic pins (24), and the positioning bead (5) and spring (51) may be pre-assembled together in a configuration suited to the configuration of the front face (11) of the lockset's rotor (1A) (such as the round plate configuration illustrated). In some cases, the slot (112) may require slight preparation or reconfiguration prior to final assembly. As the general working principle of the third preferred embodiment is the same as that described for the first preferred embodiment, the third preferred embodiment is not described in further detail.

Accordingly, the rotor case cover (2A) and the retainer (3A) of the third preferred embodiment of the present invention are restricted by the bushing (4A) in position to form a modular unit that may be used with a type of rotor in providing the lockset assembly having a cover-up mechanism for its keyway. It is to be noted that the incorporation of the rotor case cover (2A), the retainer (3A), and the rotor (1A) by means of multiple tabs (42) extending from the bushing (4A) is only a preferred embodiment of the present invention and shall not in any way restrict the present invention thereto.

I claim:

1. A lockset assembly comprising:

(a) a rotor including a rotor case cover having disposed at a front end thereof, said rotor case cover having formed therein a keyway opening and a plurality of pinholes;

(b) a plurality of magnetic pin members each received in one said pinhole of said rotor case cover in resiliently biased manner;

(c) a retainer disposed in angularly displaceable manner adjacent said rotor case cover for angular displacement between first and second positions, said retainer having formed therein a through hole configured to substantially align with said keyway opening when disposed in said first position, said retainer defining a plurality of insertion holes each engageable by at least one of said magnetic pin members to be releasably locked thereby in at least one of said first and second positions; and, (e) a key including a magnetic unlocking part engageable with said retainer for angularly displacing said retainer between said first and second positions relative to said rotor case cover, said magnetic unlocking part having a plurality of magnets disposed to magnetically actuate disengagement of said magnetic pin members from said retainer insertion holes when said key is engaged with said retainer, said retainer being released thereby for angular displacement relative to said rotor case cover.

2. The lockset assembly as recited in claim 1 further comprising a bushing coupled to capture said retainer against said rotor case cover.

3. The lockset assembly as recited in claim 1 wherein said rotor case cover includes a circumferentially extending recessed portion terminated angularly by stopper portion; and, said retainer includes first and second circumferentially extending retainer wall portions separated by a gap; said first and second retainer wall portions slidably engaging said recessed portions and being limited in displacement by said stopper portion.

4. The lockset assembly as recited in claim 1 wherein said unlocking part of said key has formed therein a slot; and, said retainer includes a bit portion protruding therefrom for engaging said slot of said unlocking part of said key.

5. A lockset assembly comprising:

(a) a rotor having a plurality of first and second positioning slots formed about a front end portion thereof;

(b) a rotor case cover coupled to said front end of said rotor, said rotor case cover defining a keyway opening and having a plurality of positioning bits extending therefrom to engage respective ones of said first positioning slots of said rotor;

(c) a retainer disposed in angularly displaceable manner adjacent said rotor case cover for angular displacement between first and second positions relative thereto, said retainer having formed therein a through hole configured to substantially align with said keyway opening when disposed in said first position, said retainer in at least one of said first and second positions being releasably locked by a plurality of displaceable magnetic pin members captured against said rotor case cover in resiliently biased manner;

(d) a bushing capturing said retainer to said rotor case cover, said bushing having a plurality of bendable tabs extending therefrom for retentively engaging respective ones of said second positioning slots of said rotor; and, (e) a key including a magnetic unlocking part engageable with said retainer for angularly displacing said retainer between said first and second positions relative to said rotor case cover, said magnetic unlocking part having a plurality of magnets disposed to magnetically actuate displacement of said magnetic pin members when said key is engaged with said retainer, said retainer being thereby released for angular displacement relative to said rotor case cover.

6. The lockset assembly as recited in claim 5 wherein said rotor case cover has formed therein a plurality of edge slots disposed for alignment with said second slots of said rotor, each said edge slot being engaged by one said tab of said bushing;

whereby said bushing, retainer, and rotor case cover are pre-assembled for modular coupling to said rotor front end portion.

* * * * *